United States Patent [19]

Campman, deceased et al.

[11] Patent Number: 4,922,969

[45] Date of Patent: May 8, 1990

[54] MULTI-LAYER WOVEN FABRIC HAVING VARYING MATERIAL COMPOSITION THROUGH ITS THICKNESS

[75] Inventors: Arthur R. Campman, deceased, late of Los Angeles, by Martha H. Campman, executrix; Dominic P. Calamito, Rancho Palos Verdes; Richard H. Pusch, Huntington Beach, all of Calif.

[73] Assignee: Hitco, Gardena, Calif.

[21] Appl. No.: 247,879

[22] Filed: Sep. 22, 1988

[51] Int. Cl.[5] ..... D03D 11/00; D03D 13/00; D03D 15/00

[52] U.S. Cl. ..... 139/408; 139/420 R; 428/240

[58] Field of Search ..... 139/408–415, 139/420 R, 420 A, 425 A, 411, 412, 413, 414; 428/257, 258, 259, 240

[56] References Cited

U.S. PATENT DOCUMENTS

| | | | |
|---|---|---|---|
| 870,697 | 11/1907 | Stevenson | 139/408 |
| 2,929,412 | 3/1960 | Abendroth | 139/408 X |
| 3,749,138 | 7/1973 | Rheaume et al. | 139/408 |
| 3,978,894 | 9/1976 | Boone | 139/408 |
| 4,209,044 | 6/1980 | Taki | 139/420 R X |
| 4,312,913 | 1/1982 | Rheaume | 428/257 |
| 4,420,529 | 12/1983 | Westhead | 428/257 X |
| 4,554,953 | 11/1985 | Bonel et al. | 139/425 A |
| 4,569,883 | 2/1986 | Renjilian | 428/257 X |

*Primary Examiner*—Andrew M. Falik

*Attorney, Agent, or Firm*—Scherlacher, Mok & Roth

[57] ABSTRACT

In a multi-layer woven fabric in which a first yarn system forms yarn layers between the opposite broad surfaces of the fabric and a second yarn system extends through the fabric thickness between the opposite broad surfaces and is interwoven with the yarn layers, at least one of the first and second yarn systems is comprised of two or more different yarn groups of different material composition disposed within different portions of the thickness of the fabric. This enables different materials such as carbon, ceramics, metals and organics to be disposed uniformly throughout the fabric thickness or to be concentrated within particular portions of the fabric thickness. In this manner multi-layer woven fabrics can be customized for particular applications in terms of their chemical, electrical, thermal, ablative, optical or other properties while retaining the advantageous structural characteristics of such fabrics. Both angle interlock and layer-to-layer weaving configurations may be used. A third or stuffer yarn system may be present and may be comprised of different material compositions at different portions of the fabric thickness where desired.

11 Claims, 4 Drawing Sheets

MULTI-LAYER WOVEN FABRIC HAVING VARYING MATERIAL COMPOSITION THROUGH ITS THICKNESS

BACKGROUND OF THE INVENTION

1. Field of the Invention

The present invention relates to multi-layer woven fabrics, and more particularly to fabrics having thicknesses comprised of multiple yarn layers and other yarns extending through and interwoven with the yarn layers.

2. History of the Prior Art

It is known in the art of multi-layer woven materials to weave a fabric from a plurality of different yarn systems which provide the fabric with multiple interwoven layers or plies of thickness. Fabrics of this type can be woven using a circular loom such that the fabrics have an essential circular makeup or configuration. Fabrics of that type are illustrated by U.S. Pat. No. 3,749,138 of Rheaume et al, which patent issued July 31, 1973 and is commonly assigned with the present application. The Rheaume et al patent describes the weaving of a multi-layer fabric which is comprised of angled warp yarns extending through the thickness of the fabric and interwoven with fill yarns which extend along the length of the fabric in an orientation generally parallel to one another and to the opposite broad surfaces of the fabric and perpendicular to the warp yarns. A third or stuffer yarn system may be present such that generally parallel stuffer yarns extend across the width of the fabric in orientations perpendicular to the fill yarns.

Multi-layer fabrics may also be woven in a non-circular configuration such as in other curved configurations or in a generally rectangular configuration using conventional weaving apparatus. An example of such woven configurations is provided by U.S. Pat. No. 4,312,913 of Rheaume, which patent issued Jan. 26, 1982. The Rheaume patent illustrates fabric produced by an angle weave in which lengths of fill yarn disposed in a nominally parallel configuration are interwoven with angled warp yarns. The warp yarns extend in a zig-zag configuration through the thickness of the fabric between the opposite broad surfaces thereof so as to form a succession of intersecting warp sheets. The warp sheets intersect with and form acute angles with the opposite broad surfaces of the woven fabric. In the woven fabrics of the Rheaume patent, the warp yarns which extend in angled fashion through the entire thickness of the fabric are comprised of high heat conductivity compositions which may be different from one another as well as from the compositions of the fill yarns, and which are designed to maximize the flow of heat through the thickness of the fabric from an adjoining substrate. In addition to or in lieu thereof, the fill yarn layers may be interleaved with stuffer yarn layers of different composition.

The multi-layer woven fabrics described in U.S. Pat. No. 3,749,138 of Rheaume et al and U.S. Pat. No. 4,312,913 of Rheaume are typical of woven angled fabrics in which one yarn system, typically the warp yarn system, extends through the entire thickness of the fabric to provide an integral, tightly woven multi-layer fabric having generally uniform properties throughout the thickness thereof. Such structures are advantageous for many applications calling for multi-layer fabrics with good structural and other properties. However, it may be desirable for certain applications to provide multi-layer woven fabrics which not only have the advantageous structural characteristics of such fabrics but which also are customized in their construction so as to optimize different material properties or characteristics throughout different portions of the woven fabric. For example, it may be desirable to provide a woven fabric having high resistance to thermal or electrical conductivity through the thickness thereof in spite of a tightly woven configuration in which some of the yarns extend through the entire thickness of the fabric. Other applications may suggest the presence of high oxidation resistance material at a surface of the fabric but not throughout the remainder of the fabric. Still further applications may suggest a fabric having an ablative surface, chemically resistive properties or optically reflective properties.

SUMMARY OF THE INVENTION

The foregoing and other objects are accomplished in accordance with the invention by providing a multi-layer woven fabric which is graded in that it has at least one yarn system which is comprised of at least two different yarn groups of different material composition located within different portions of the thickness of the fabric between opposite broad surfaces of the fabric. Such fabrics are woven by forming a plurality of yarn layers between the opposite broad surfaces of the fabric from a first yarn system and interweaving the yarns of a second yarn system with the yarn layers of the first yarn system, the second yarn system extending through the entire thickness of the fabric between the opposite broad surfaces thereof. The first and second yarn systems may comprise fill and warp yarn systems respectively, or vice versa, depending upon the weaving technique employed and the loom used to carry out the weaving. The fabric may be provided with any number of yarn layers as desired and depending on the capabilities of the loom used to weave the fabric.

In accordance with the invention, one or both of the first and second yarn systems are divided into at least two yarn groups of different material composition located within different portions of the fabric thickness. This provides for the optimization of chemical, electrical, thermal, and other properties for particular applications while at the same time retaining the advantageous structured properties of multi-layer woven fabrics of this type. The different material composition of the two or more different yarn groups derives from a mixture of materials such as carbon, ceramics, metals and organic materials. Each yarn system may be provided with any desired number of yarn groups in any desired locations within the fabric thickness, again depending on the capabilities of the loom used to weave the fabric.

Fabrics in accordance with the invention may include a third or stuffer yarn system having a plurality of layers disposed between the opposite broad surfaces of the fabric which are comprised of yarn lengths extending in directions perpendicular to the directions of the yarn lengths forming the yarn layers of the first yarn system. The third or stuffer yarn system may be comprised of two or more different yarn groups of different material composition, or such third yarn system may be of like material composition throughout.

Where the first yarn system is comprised of two or more yarn groups of different material composition, at least one layer of the first yarn system is provided with a different material composition from the remaining layers of the first yarn system. Yarns of a first material composition may extend from one of the opposite broad surfaces of the fabric to an intermediate layer part way through the thickness of the fabric, with the remaining layers of the first yarn system between the intermediate layer and the opposite broad surface of the fabric being of different material composition.

Where the second yarn system is comprised of two or more yarn groups of different material composition, one such group of yarns may extend through a portion of the thickness of the fabric with another group of yarns extending through the remaining portion of the fabric thickness. Alternatively, one yarn group can extend through the entire thickness of the fabric with the other yarn group extending through a portion of the fabric thickness.

Multi-layer fabrics in accordance with the invention may be of the so-called angle interlock type in which the yarns of the second yarn system extend alternately back and forth or repeatedly through part or all of the fabric thickness in zig-zag fashion and form acute angles with the planes of the yarn layers of the first yarn system as well as with the opposite broad surfaces of the fabric. In fabrics of this type both the first and second yarn systems or either of them can be comprised of yarn groups of different material composition.

Multi-layer fabrics in accordance with the invention can also comprise so-called layer-to-layer fabrics in which a first group of yarns of the second yarn system are confined to different ones of the yarn layers of the first yarn system so as to form distinct interwoven layers with a second group of yarns of the second yarn system interweaving with and thereby coupling together adjacent pairs of the woven yarn layers. In fabrics of this type either or both of the first and second yarn systems can be comprised of two or more yarn groups of different material composition.

BRIEF DESCRIPTION OF THE DRAWINGS

A better understanding of the invention may be had by reference to the following description, taken in conjunction with the accompanying drawings, in which.

DETAILED DESCRIPTION

Figure 1:
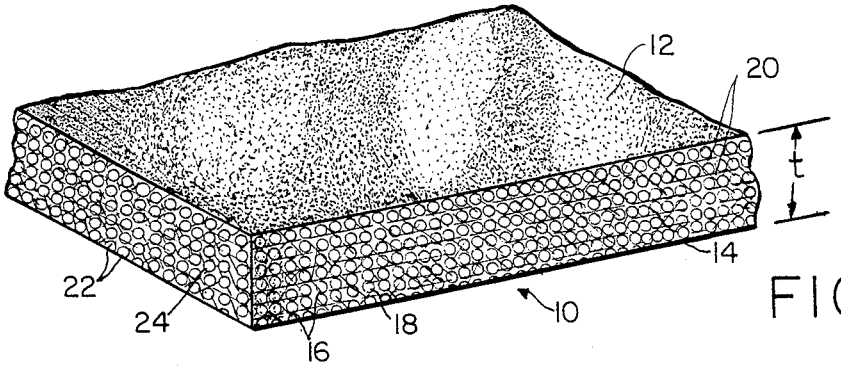
FIG. 1 is a perspective view of a multi-layer woven fabric in accordance with the invention.

FIG. 1 depicts a multi-layer woven fabric 10 in accordance with the invention. The fabric 10 has a thickness "t" defined by the distance between opposite broad surfaces 12 and 14 thereof. The thickness "t" is generally uniform throughout the fabric 10. In the particular example of FIG. 1, the fabric 10 is of generally rectangular configuration so that opposite broad surfaces 12 and 14 thereof are generally planar. However, it should be understood that the present invention is applicable to other fabric configurations including curved fabrics in which the opposite broad surfaces thereof are curved rather than planar.

The multi-layer woven fabric 10 is comprised of two or more interwoven yarn systems. A first yarn system 16 is comprised of a plurality of yarn lengths 18 which are generally parallel with one another and which extend generally in a common direction along the length of the fabric 10. The yarn lengths 18 of the first yarn system 16 are arranged into a plurality of yarn layers 20 disposed between and generally parallel to the opposite broad surfaces 12 and 14. The yarn layers 20 are stacked together in generally parallel fashion. Yarn layers at the opposite ends of the stack help to form the opposite broad surfaces 12 and 14 of the fabric 10.

The multi-layer woven fabric 10 includes a second yarn system 22 extending through the thickness of the fabric 10 between the opposite broad surfaces 12 and 14 and being interwoven with the layers 20 of the first yarn system 16. The second yarn system 22 ties together the yarn layers 20 of the first yarn system 16 to provide the fabric 10 with an integral, interwoven construction.

The second yarn system 22 is comprised of a plurality of yarn lengths 24 which extend through at least a portion of the thickness of the fabric 10 between two or more of the yarn layers 20 of the first yarn system 16. Different arrangements are possible in accordance with the invention. Thus, all of the yarn lengths 24 of the second yarn system 22 may extend through the entire thickness of the fabric 10. Alternatively, the yarn lengths 24 may be divided into different groups of yarn lengths which extend through different portions of the thickness of the fabric 10.

Still further options are possible depending upon the type of multi-layer woven fabric which the fabric 10 comprises. For example, the fabric 10 may be of the angle interlock type in which the yarn lengths 24 extend along angled paths through the thickness of the fabric 10 so as to lie within yarn sheets forming acute angles with the yarn layers 20 and with the broad surfaces 12 and 14. Alternatively, the fabric 10 may be of the layer-to-layer type in which a first plurality of the yarn lengths 24 of the second yarn system 22 are confined to individual ones of the yarn layers 20 where they are interwoven with the yarns lengths 18 of the first yarn system 16. A second plurality of the yarn lengths 24 of the second yarn system 22, in such a layer-to-layer fabric, extend between and tie together the yarn layers 20 of the first yarn system 16 interwoven with the first plurality of yarn lengths 24 of the second yarn system 22.

As described in some of the examples hereafter, the multi-layer woven fabric 10 may include a third yarn system comprised of yarn lengths extending generally in a common direction perpendicular to the common direction of the yarn lengths 18 of the first yarn system 16 and arranged into yarn layers.

As described hereafter, a conventional loom may be employed to weave the fabric 10. The first yarn system 16 is typically provided by the fill yarns of the loom, but alternatively may be provided by the warp yarns of the loom. The second yarn system 22 is typically provided by the warp yarns of the loom, but alternatively may be provided by the fill yarns of the loom where the warp yarns of the loom are used to form the first yarn system 16. Where a third yarn system is present in the fabric 10, such system is typically provided by the stuffer yarns of the loom. The fabric 10 may have as many of the yarn layers 20 as desired, depending upon the capabilities of the loom used to weave the fabric 10.

In accordance with the invention, at least one of the yarn systems of the multi-layer woven fabric 10 is comprised of two or more different yarn groups of different material composition disposed within different portions of the thickness of the fabric 10. This results in a "graded" fabric in which different materials may be advantageously concentrated within different portions of the fabric thickness to provide particular advantages. For example, materials offering a high resistance to oxidation, materials which are ablative, or materials which are optically reflective, can be concentrated at one or both of the opposite broad surfaces 12 and 14 of the fabric 10 without having to dispose such materials throughout the fabric thickness. Also, certain materials can be used in yarns extending exclusively in one direction through the fabric to maximize or minimize conductivity of heat or electricity in that direction to the exclusion of other directions through the fabric.

Any one or more of the yarn systems of the fabric 10 may be comprised of two or more yarn groups of different material composition. Thus, the first yarn system 16 can have yarns of a first material forming one or more of the yarn layers 20 adjacent one of the opposite broad surfaces 12 and 14, with the remaining yarn layers 20 being formed of a different material. The second yarn system 22 can be comprised of two or more yarns groups of different material in addition to or in lieu of the first yarn system 16 being comprised of two or more yarn groups. One yarn group of the second yarn system 22 can extend through the entire thickness of the fabric 10 between the opposite broad surfaces 12 and 14 with a second yarn group of the second yarn system 22 extending through part but less than all of the thickness. Moreover, the fabric 10 can be configured so that one of the yarn groups of the second yarn system 22 alternates between extension through the entire fabric thickness and extension through part but less than all of the fabric thickness. Alternatively, the second yarn system 22 may be comprised of a first yarn group of one material composition extending from the broad surface 12 to an intermediate location within the thickness of the fabric 10, with a second yarn group of different material composition extending between the intermediate location and the opposite broad surface 14.

Where a third yarn system is present within the fabric 10, such third yarn system can be comprised of two or more yarn groups of different material composition where desired.

The two or more yarn groups of different material composition within any one or more of the yarn systems can be comprised of materials selected to achieve certain properties within the fabric 10. Properties which may be optimized for particular applications include chemical, electrical, thermal and optical properties, as well as structural properties. Typical materials which the yarns may be made of include carbon fibers, ceramic fibers, and metallic fibers or wire. Organic materials which can be used include Kevlar, polyester, nylon and polypropylene. Also, one or more of the yarns can be a hybrid of different materials. Any one or more of the yarn systems of the fabric 10 can be comprised of as many yarn groups as desired in particular locations desired, depending upon the capabilities of the loom used to weave the fabric 10.

Figure 2:
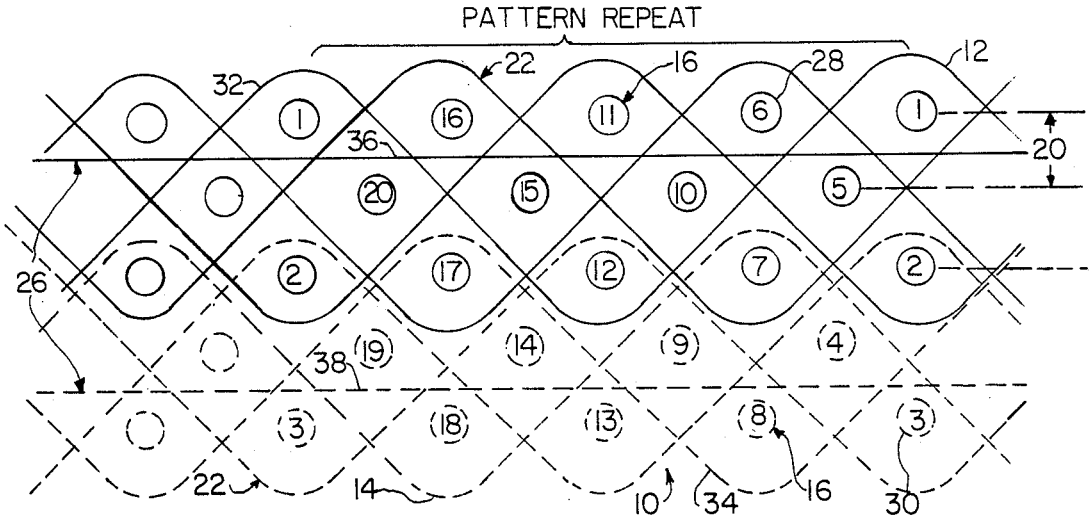
FIG. 2 is a schematic view in sectional side elevation illustrating a first embodiment of a multi-layer woven fabric in accordance with the invention in which each of three different yarn systems is comprised of two groups of yarns of different material composition.

FIG. 2 comprises one example of the multi-layer woven fabric 10 in accordance with the invention. In the example of FIG. 2, the fabric 10 includes a third yarn system 26 in addition to the first yarn system 16 and the second yarn system 22. Each of the three different yarn systems 16, 22, and 26 in the example of FIG. 2 is comprised of two different groups of yarns which may be of different material composition. The first yarn system 16 is divided into first and second yarn groups 28 and 30 which together define five different yarn layers 20. The first yarn system 16 is shown in section in FIG. 2, with the first yarn group 28 being in solid outline and the second yarn group 30 being in dotted outline. The first yarn group 28 comprises the top three yarn layers 20 and extends from the broad surface 12 at the top of the fabric 10 to an intermediate location within the thickness of the fabric 10. The second yarn group 30 which comprises the lower two yarn layers 20 extends from the intermediate location to the opposite broad surface 14 at the bottom of the fabric 10. The first and second yarn groups 28 and 30 may be of different material composition so as to concentrate a first material within a first portion of the thickness of the fabric 10 comprising the upper three-fifths of the fabric thickness. The different material comprising the second yarn group 30 is located within a different portion of the thickness of the fabric 10 comprising the lower two-fifths of the fabric thickness.

In the example of FIG. 2, the second yarn system 22 is comprised of first and second yarn groups 32 and 34. The first and second yarn groups 32 and 34 extend through different portions of the thickness of the fabric 10. The first yarn group 32 extends repeatedly through a top portion of the thickness of the fabric 10 so as to be interwoven with the first yarn group 28 of the first yarn system 16. The first yarn group 32 is shown in solid outline. The second yarn group 34 which is shown in dotted outline extends repeatedly through a lower portion of the thickness of the fabric 10 so as to be interwoven with the lower two yarn layers 20 comprised of the second yarn group 30 of the first yarn system 16 and the lowermost of the upper three yarn layers 20 comprised of the first yarn group 28 of the first yarn system 16.

In the example of FIG. 2, the fabric 10 includes the third yarn system 26, the yarns of which extend in a generally common direction across the width of the fabric 10 so as to be perpendicular to the direction of the yarns within the first yarn system 16 as well as being disposed between the yarn layers 20 of the first yarn system 16. The third yarn system 26 is comprised of first and second yarn groups 36 and 38 shown in solid outline and dotted outline respectively. The first yarn group 36 is disposed between the top two yarn layers 20 of the first yarn system 16. The second yarn group 38 is disposed between the bottom two yarn layers 20 of the first yarn system 16. The first and second yarn groups 36 and 38 of the third yarn system 26 may be of different material composition so as to concentrate the material of the first yarn group 36 adjacent the top of the fabric 10 at the broad surface 12 and the material of the second yarn group 38 adjacent the bottom of the fabric 10 at the broad surface 14.

The fabric 10 in the example of FIG. 2 is woven in conventional fashion except that each of the three different yarn systems 16, 22, and 26 requires that yarns of two different material compositions be fed into the loom during the weaving process. In addition, the introduction of the second yarn system 22 into the loom is programmed so that the first and second yarn groups 32 and 34 thereof only extend through their respective portions of the thickness of the fabric 10.

The fabric 10 of FIG. 2 may be woven using a conventional fly-shuttle loom, an example of which is the Model XD loom manufactured by The Draper Corporation. The first yarn system 16 is provided by the fill yarn system of the loom, with one shuttle being used to provide the first yarn group 28 thereof and a second shuttle being used to provide the second yarn group 30. The two different shuttles carry bobbins of yarns comprising the two different materials of the yarn groups 28 and 30. The second and third yarn systems 22 and 26 are provided by the warp yarn system of the loom, the system 22 being provided by the warp weaver yarns and the system 26 being provided by the warp stuffer yarns. The second yarn system 22 is comprised of two warp yarn groups 32 and 34, each of which is made up of four individual warp yarn layers. Accordingly, eight different harnesses are used to handle the yarn groups 32 and 34. Bobbins of one kind of yarn material provide the yarn group 32, while bobbins of another kind of yarn material provide the yarn group 34. Two additional harnesses are used for the third yarn system 26, one for the first yarn group 36 and the other for the second yarn group 38. The ten different harnesses are programmed to be lifted by a harness pattern chain. The two different shuttles are programmed to traverse the fabric width according to a weaving sequence depicted by numbers on the ends of the first or fill yarn system 16 shown in FIG. 2. The numbers designate the picking sequence and show that there are twenty fill yarn picks for each pattern repeat.

A conventional loom with a Jacquard machine for programming can also be used to weave fabrics in accordance with the invention, such as the fabric shown in FIG. 2. Jacquard looms are advantageous in those situations where the fabric to be woven requires more harnesses than most fly-shuttle looms are equipped with.

Figure 3:
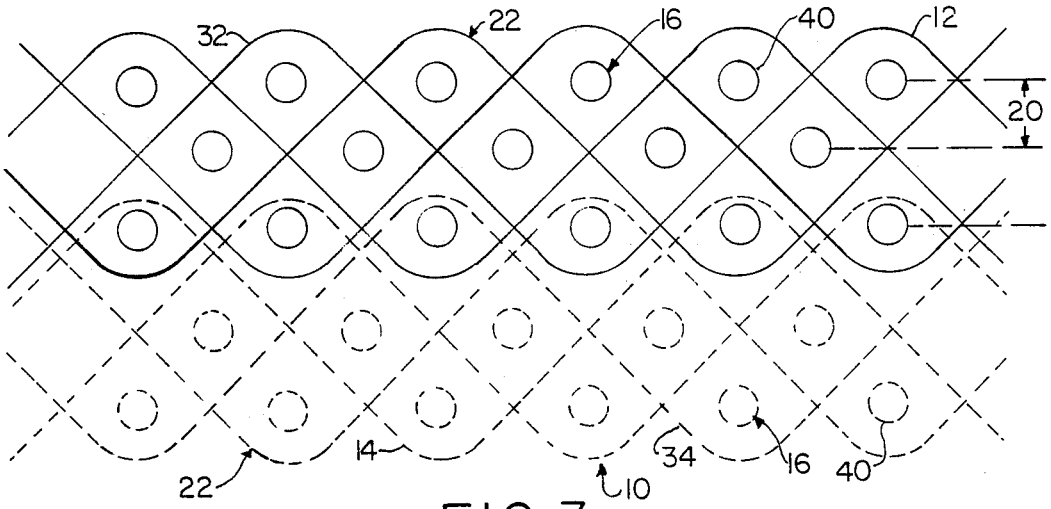
FIG. 3 is a schematic view in sectional side elevation illustrating a second embodiment of a multi-layer woven fabric in accordance with the invention in which only the second of two different yarn systems is comprised of two groups of yarns of different material composition which extend through different portions of the thickness of the fabric.

In the example of FIG. 3, the fabric 10 is similar to the example of FIG. 2 to the extent that the first yarn system 16 provides five different yarn layers 20 and the second yarn system 22 is comprised of the yarn groups 32 and 34 extending through different portions of the thickness of the fabric 10. In the example of FIG. 3, however, the first yarn system 16 is comprised of but a single group 40 of yarns of like material composition. Also, there is no third yarn system 26. In these two respects the example of FIG. 3 is of simpler configuration than the example of FIG. 2. Nevertheless, the presence of the first and second yarn groups 32 and 34 of the second yarn system 22 provides for the disposition of different materials within different portions of the thickness of the fabric 10.

In weaving the fabric 10 of FIG. 3 using a conventional fly-shuttle loom, the single yarn group 40 of the first yarn system 16 requires only a single shuttle. The second yarn system 22 requires eight harnesses, four for the first yarn group 32 and four for the second yarn group 34.

Figure 4:
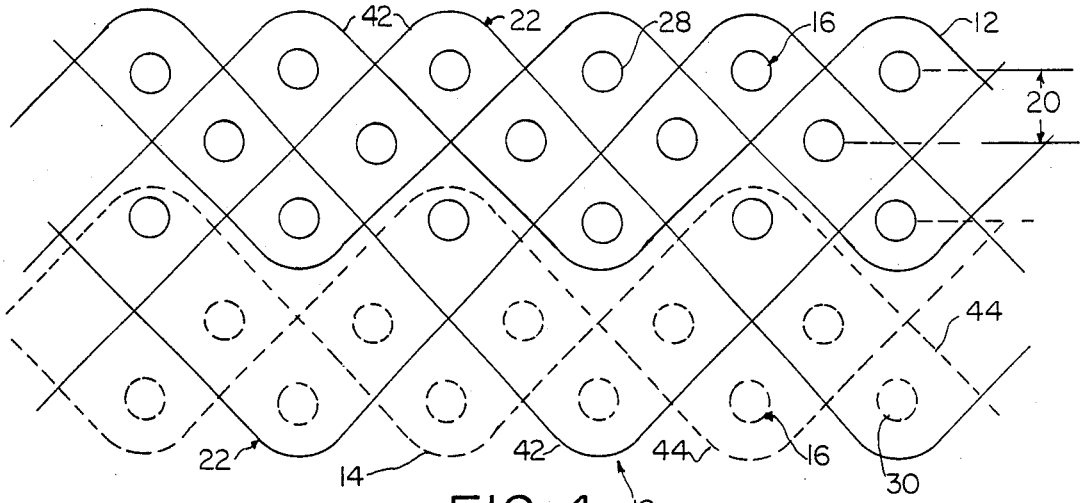
FIG. 4 is a schematic view in sectional side elevation illustrating a third embodiment of a multi-layer woven fabric in accordance with the invention in which both first and second yarn systems are comprised of two groups of yarns of different material composition and in which the second yarn system includes yarns extending through a portion of the thickness of the fabric and yarns extending through the entire thickness of the fabric.

The example of FIG. 4 is similar to that of FIG. 2 to the extent that the first yarn system 16 is divided into the first and second yarn groups 28 and 30 which respectively comprise the top three and the bottom two yarn layers 20 of the fabric 10. Unlike the example of FIG. 2, however, the example of FIG. 4 does not utilize the third yarn system 26. Also, in the example of FIG. 4 the second yarn system 22 is different from the example of FIG. 2.

In the FIG. 4 example, the second yarn system 22 is comprised of first and second yarn groups 42 and 44 which are of different material composition and which are respectively shown in solid and dotted outline. The first yarn group 42 which is shown in solid outline is comprised of yarns which extend repeatedly through and are interwoven with only a top portion of the fabric 10 comprised of the first yarn group 28 of the first yarn system 16 and also of yarns which extend repeatedly through the entire thickness of the fabric 10 between the opposite broad surfaces 12 and 14. The second yarn group 44 is comprised of yarns which extend repeatedly through a lower portion of the thickness of the fabric 10 comprised of the bottom two yarn layers 20 of the second yarn group 30 of the first yarn system 16 and the lowermost of the top three yarn layers 20 provided by the first yarn group 28 of the first yarn system 16. In the example of FIG. 4, both the first yarn system 16 and the second yarn system 22 dispose different materials within different portions of the thickness of the fabric 10. In addition, the different extents of travel of the first yarn group 42 of the second yarn system 22 through the thickness of the fabric 10 provides different structural considerations.

In weaving the fabric 10 of FIG. 4 using a conventional fly-shuttle loom, the first and second yarn groups 28 and 30 of the first yarn system 16 require two different shuttles. The first yarn group 42 of the second yarn system 22 requires five harnesses, and the second yarn group 44 requires two harnesses.

Figure 5:
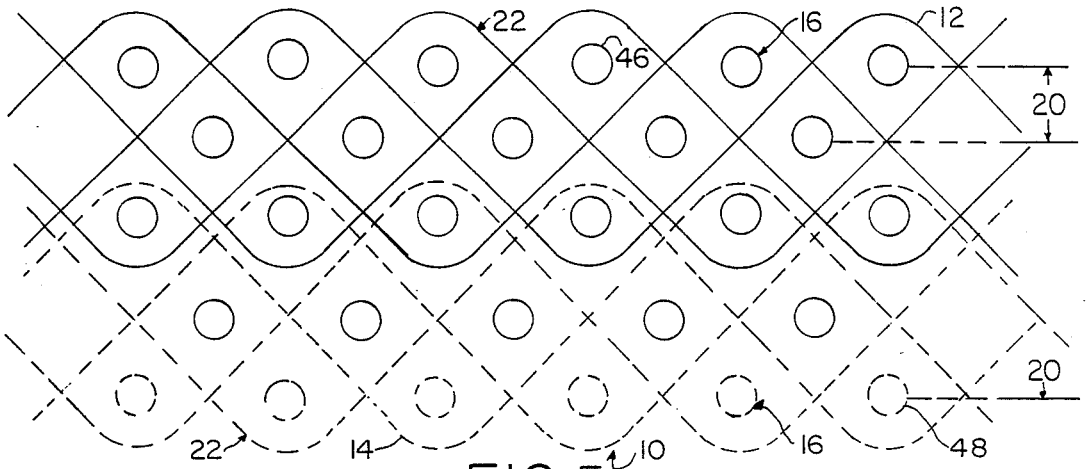
FIG. 5 is a schematic view in sectional side elevation illustrating a fourth embodiment of a multi-layer woven fabric in accordance with the invention in which both first and second fabric systems are comprised of two groups of yarns of different material composition residing within different portions of the thickness of the fabric.

The example of FIG. 5 is similar to the example of FIG. 2 in terms of the second yarn system 22. The first yarn system 16 in the example of FIG. 5 is comprised of first and second yarn groups 46 and 48 which are of different material composition and which are shown in solid and dotted outline respectively. The first yarn group 46 comprises the top four of the yarn layers 20 of the first yarn system 16, with the second yarn group comprising the lowermost or fifth yarn layer 20 of the first yarn system 16. In the example of FIG. 5 the fabric 10 has no third yarn system.

In weaving the fabric 10 of FIG. 5 using a conventional fly-shuttle loom, the first and second yarn groups 46 and 48 of the first yarn system 16 require two different shuttles. The two different materials of the second yarn system 22 require four harnesses each.

Figure 6:
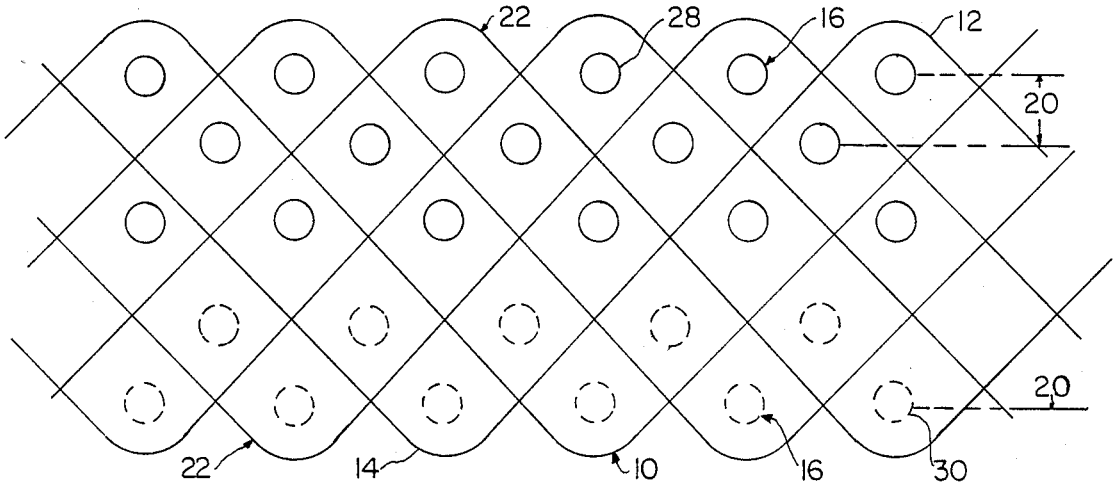
FIG. 6 is a schematic view in sectional side elevation illustrating a fifth embodiment of a multi-layer woven fabric in accordance with the invention in which the first yarn system comprises two groups of yarns of different material composition residing within different portions of the thickness of the fabric and the second yarn system is comprised of yarns which extend through the entire thickness of the fabric.

In the example of FIG. 6, the first yarn system 16 is like that of the example of FIG. 2 in that it is comprised of the first and second yarn groups 28 and 30 which are of different material composition and which form the upper three and the lower two yarn layers 20 respectively. The second yarn system 22 is comprised of a single group of yarns which extend repeatedly through the entire thickness of the fabric 10 between the opposite broad surfaces 12 and 14. There is no third yarn system in the example of FIG. 6. Although the fabric 10 shown in the example of FIG. 6 is of simpler construction than the fabric in the example of FIG. 2, nevertheless the presence of the first and second yarn groups 28 and 30 of the first yarn system 16 disposes different materials within different portions of the thickness of the fabric 10.

In weaving the fabric 10 of FIG. 6 using a conventional fly-shuttle loom, the first and second yarn groups 28 and 30 of the first yarn system 16 require two different shuttles. The single yarn group of the second yarn system 22 requires a single group of six harnesses.

In the examples of FIGS. 2-6 the fabric 10 is of the angle interlock type in that the second yarn system 22 extends through the entire thickness of the fabric 10 in angled, repeating fashion, and at least some of the yarns of the second yarn system 22 are interwoven with and extend between three or more of the yarn layers 20 of the first yarn system 16. The yarns of the second yarn system 22 are arranged into yarn sheets which form acute angles with the yarn layers 20 and with the opposite broad surfaces 12 and 14.

Figure 7:
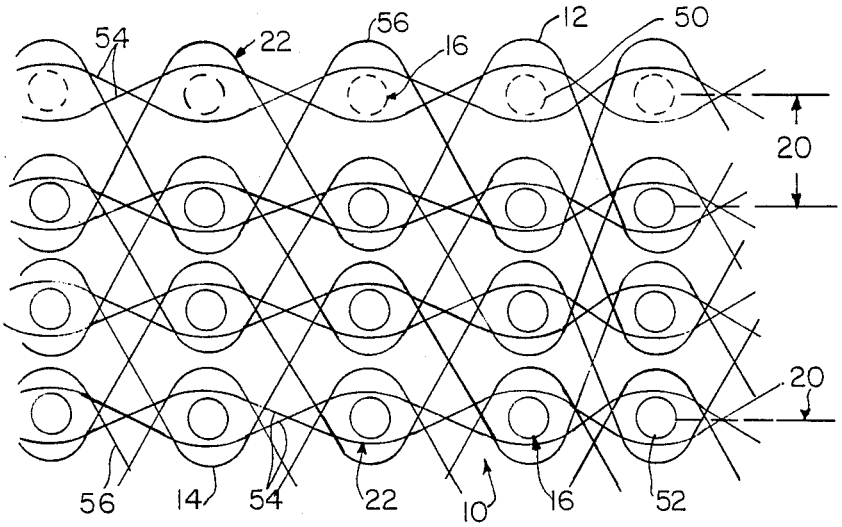
FIG. 7 is a schematic view in sectional side elevation illustrating a sixth embodiment of a multi-layer woven fabric in accordance with the invention in which adjacent layers of interwoven yarns are interwoven to form a layer-to-layer fabric in which the yarns of the first yarn system within one of the layers adjacent one of the opposite broad surfaces of the fabric is of different material composition from the yarns of the first yarn system within the remaining layers.
Figure 8:
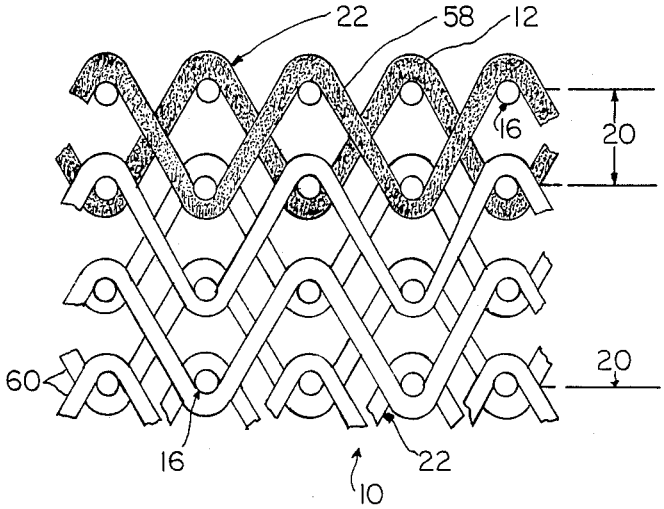
FIG. 8 is a schematic view in sectional side elevation illustrating a seventh embodiment of a multi-layer woven fabric in accordance with the invention in which adjacent layers of the first yarn system are interwoven with yarns of the second yarn system to form a layer-to-layer fabric in which the yarns of the second yarn system which interweave an adjacent pair of layers at one side of the fabric are of different material composition from the yarns of the second yarn system interweaving the remaining layers.

In the examples of FIGS. 7 and 8 which are of layer-to-layer type construction, the yarns of the second yarn system 22 extend no further through the thickness of the fabric 10 than between adjacent pairs of the yarn layers 20 of the first yarn system 16. Nevertheless, the second yarn system 22 can be divided into two or more yarn groups of different material composition as illustrated in the example of FIG. 8, and the first yarn system 16 can be divided into two or more yarn groups of different material composition as shown in the example of FIG. 7. Although not shown by the examples of FIGS. 7 and 8, fabrics of layer-to-layer construction can have both the first and the second yarn systems 16 and 22 thereof comprised of two or more yarn groups of different material composition.

In the example of FIG. 7, the first yarn system 16 is comprised of first and second yarn groups 50 and 52 shown respectively in dotted outline and in solid outline. The first yarn group 50 comprises the very top yarn layer 20 of the fabric 10. The second yarn group 52 comprises the remaining yarn layers 20 of the fabric 10. The first yarn group 50 is of different material composition from the second yarn group 52, and the material of the first yarn group 50 is thereby concentrated at the broad surface 12 at the top of the fabric 10. The second yarn system 22 includes a first plurality of yarns 54, each of which is confined to one of the yarn layers 20 so as to be interwoven with the yarns of the first yarn system within that particular yarn layer 20. The second yarn system 22 also includes a second plurality of yarns 56 which extend between and interweave with adjacent pairs of the yarn layers 20.

In weaving the fabric 10 of FIG. 7 using a conventional fly-shuttle loom, the first and second yarn groups 50 and 52 of the first yarn system 16 require two different shuttles. The pluralities of yarns 54 and 56 of the second yarn system 22 require a single group of fifteen harnesses. After each eight fill yarn picks, the pattern repeats.

In the example of FIG. 8 the first yarn system 16 is of like material composition throughout. The second yarn system 22 includes a first yarn group 58 thereof which extends between and is interwoven with the top two yarn layers 20 of the first yarn system 16. The first yarn group 58 is shown in darkened fashion in FIG. 8, and disposes the material thereof adjacent the broad surface 12 at the top of the fabric 10. The second yarn system 22 also includes a second yarn group 60 extending between and interwoven with the remaining adjacent pairs of the yarn layers 20 of the first yarn system 16.

In weaving the fabric 10 of FIG. 8 using a conventional fly-shuttle loom, the first yarn system 16 requires a single shuttle. The first and second yarn groups 58 and 60 of the second yarn system 22 require groups of two and five harnesses. After each eight fill yarn picks, the pattern repeats.

Figure 9:
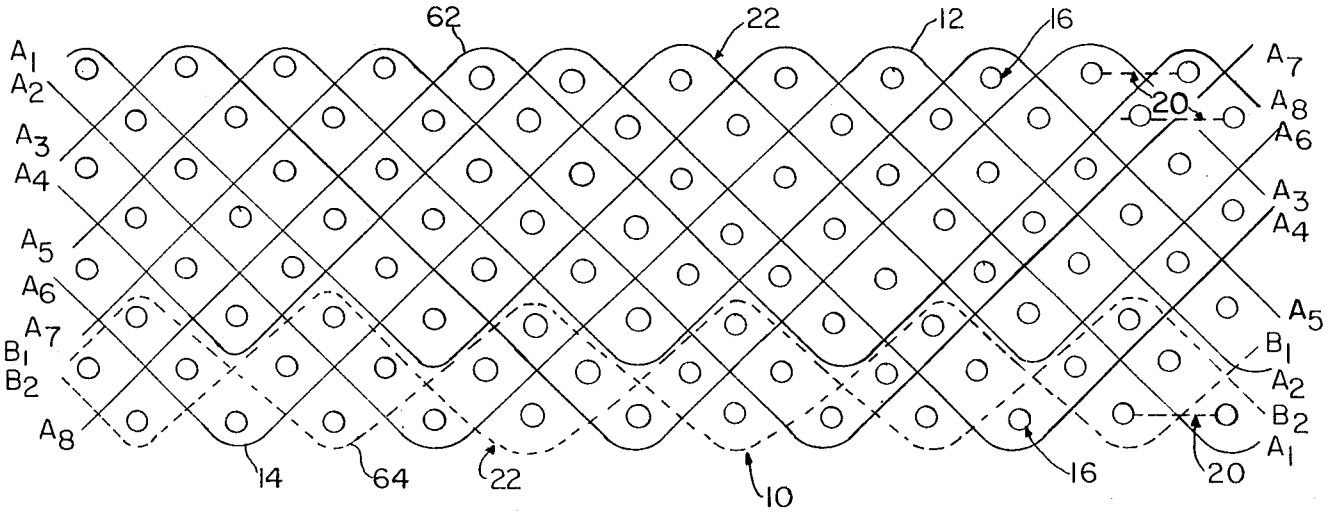
FIG. 9 is a schematic view in sectional side elevation illustrating an eighth embodiment of a multi-layer woven fabric in accordance with the invention in which the second yarn system is comprised of two different groups of yarns of different material composition, one of which extends through a portion of the fabric thickness and the other of which is comprised of yarns extending alternately through part and then all of the fabric thickness.

FIG. 9 provides a more complex example of the fabric 10 in which the fabric 10 is woven in an angle interlock configuration. The first yarn system 16 is of like material composition throughout and forms eight different yarn layers 20. The second yarn system 22 is comprised of first and second yarn groups 62 and 64 which are of different material composition and which are illustrated in solid outline and in dotted outline respectively. For clarity of illustration, the yarns of the first yarn group 62 are identified as $A_1$–$A_8$. The yarns of the second yarn group 64 are identified as $B_1$ and $B_2$. The yarns $B_1$ and $B_2$ of the second yarn group 64 extend through a limited portion of the total thickness of the fabric 10 comprised of the lowest three of the yarn layers 20 of the first yarn system 16. The yarns of the first yarn group 62 alternate between extending through a portion of the thickness of the fabric 10 and through the entire thickness of the fabric 10. Thus, each of the yarns $A_1$–$A_8$ extends through a portion of the thickness of the fabric 10 comprised by the top six yarn layers 20 of the fill yarn system 16, following which the yarn extends through the entire thickness of the fabric 10 between the opposite broad surfaces 12 and 14. In the example of FIG. 9 the second yarn group 64 of the second yarn system 22 concentrates the material thereof adjacent the lower broad surface 14 of the fabric 10 to the exclusion of the remaining portions of the thickness of the fabric 10.

In weaving the fabric 10 of FIG. 9 using a conventional fly-shuttle loom, the first yarn system 16 requires a single shuttle. The yarns $A_1$–$A_8$ comprising the first yarn group 62 of the second yarn system 22 require a group of eight harnesses, while the yarns $B_1$ and $B_2$ of the second yarn group 64 of the second yarn system 22 require two harnesses. The thickness of the fabric is such that 128 fill yarn picks are required for each pattern repeat.

All of the weaving methods described thus far have assumed the first yarn system 16 to be comprised of fill yarns and the second and third yarn systems 22 and 26 to be comprised of warp yarns. However, it should be understood that other techniques are possible such as one in which the first yarn system 16 is formed from warp yarns and the second and third yarn systems 22 and 26 are formed from fill yarns.

While there have been shown and described above particular arrangements in accordance with the invention for the purpose enabling a person of ordinary skill in the art to make and use the invention, it will be appreciated that the invention is not limited thereto. Accordingly, any modifications, variations, or equivalent arrangements within the scope of the attached claims should be considered to be within the scope of the invention.

What is claimed is:

1. A woven fabric having a thickness between opposite broad surfaces thereof and comprising a first yarn system arranged into a plurality of layers of yard between the opposite surfaces of the fabric, a second yarn system extending through the fabric thickness between the opposite broad surfaces and being interwoven with the layers of yarn of the first yarn system, at least one of the first and second yarn systems being comprised of at least two different groups of yarns of different material composition and extending through different portions of the thickness of the fabric and at least one of the at least two different groups of yarns extending through at least two of the plurality of layers of yarn, and a third yarn system arranged into a plurality of layers of yarn between the opposite broad surfaces of the fabric, the layers of yarn of the third yarn system being comprised of yarn lengths extending generally perpendicular to yarn lengths comprising the layers of yarn of the first yarn system, and the third yarn system being comprised of at least two different groups of yarns of different material composition and extending through different portions of the thickness of the fabric.

2. A woven fabric having a thickness between opposite broad surfaces thereof and comprising a first yarn system arranged into a plurality of layers of yarn between the opposite broad surfaces of the fabric, a first group of the layers of yarn between one of the opposite broad surfaces of the fabric and an intermediate location within the thickness of the fabric being of a first material composition and a second group of the layers of yarn between the intermediate location within the thickness of the fabric and the other one of the opposite broad surfaces of the fabric being of a second material composition different from the first material composition, and a second yarn system extending through the fabric thickness between the opposite broad surfaces and being interwoven with the layers of yarn of the first yarn system, the first yarn system consisting of fill yarns and the second yarn system consisting of warp yarns.

3. A woven fabric having a thickness between opposite broad surfaces thereof and comprising a first yarn system arranged into a plurality of layers of yarn between the opposite broad surfaces of the fabric, a first group of the layers of yarn between one of the opposite broad surfaces of the fabric and an intermediate location within the thickness of the fabric being of a first material composition and a second group of the layers of yarn between the intermediate location within the thickness of the fabric and the other one of the opposite broad surfaces of the fabric being of a second material composition different from the first material composition, and a second yarn system extending through the fabric thickness between the opposite broad surfaces and being interwoven with the layers of yarn of the first yarn system, the second yarn system being comprised of a plurality of yarns, each of which extends repeatedly through the entire thickness of the fabric between the opposite broad surfaces.

4. A woven fabric having a thickness between opposite broad surfaces thereof and comprising a first yarn system arranged into a plurality of layers of yarn between the opposite broad surfaces of the fabric, a first group of the layers of yarn between one of the opposite broad surfaces of the fabric and an intermediate location within the thickness of the fabric being of a first material composition and a second group of the layers of yarn between the intermediate location within the thickness of the fabric and the other one of the opposite broad surfaces of the fabric being of a second material composition different from the first material composition, and a second yarn system extending through the fabric thickness between the opposite broad surfaces and being interwoven with the layers of yarn of the first yarn system, the second yarn system being comprised of two different groups of yarns of different material composition and extending through different portions of the thickness of the fabric.

5. The invention set forth in claim 4, wherein one of the two different groups of yarns of the second yarn system has some yarns thereof repeatedly extending through a first portion of the thickness of the fabric between one of the opposite broad surfaces and one of the plurality of layers of yarns of the first yarn system and other yarns thereof repeatedly extending through the entire thickness of the fabric between the opposite broad surfaces, and the other one of the two different groups of yarns of the second yarn system repeatedly extends through a second portion of the thickness of the fabric between the other one of the opposite broad surfaces and said one of the plurality of layers of yarns of the first yarn system.

6. The invention set forth in claim 4, wherein one of the two different groups of yarns of the second yarn system extends repeatedly through a first portion of the thickness of the fabric between one of the opposite broad surfaces and one of the plurality of layers of yarns of the first yarn system, and the other one of the two different groups of yarns of the second yarn system extends repeatedly through a second portion of the thickness of the fabric between the other one of the opposite broad surfaces and said one of the plurality of layers of yarn of the first yarn system.

7. The invention set forth in claim 6, further including a third yarn system arranged into a plurality of layers of yarn between the opposite broad surfaces of the fabric, the layers of yarn of the third yarn system being comprised of yarn lengths extending generally perpendicular to yarn lengths comprising the layers of yarn of the first yarn system, a first group of the layers of yarn of the third yarn system between one of the opposite broad surfaces of the fabric and an intermediate location within the thickness of the fabric being of a first material composition and a second group of the layers of yarn of the third yarn system between the intermediate location within the thickness of the fabric and the other one of the opposite broad surfaces of the fabric being of a second material composition different from the first material composition.

8. A woven fabric having a thickness between opposite broad surfaces thereof and comprising a first yarn system arranged into a plurality of layers of yarn between the opposite broad surfaces of the fabric and a second yarn system extending through the fabric thickness between the opposite broad surfaces and being interwoven with the layers of yarn of the first yarn system, the second yarn system being comprised of two different groups of yarn of different material composition, the first group being comprised of yarns extending alternately through a first portion of the thickness of the fabric between a first one of the opposite broad surfaces and a given one of the plurality of layers of yarn of the first yarn system and through the entire thickness of the fabric between the opposite broad surfaces and the second group extending through a second portion of the thickness of the fabric between the second one of the opposite broad surfaces and the given one of the plurality of layers of yarn of the first yarn system.

9. A woven fabric having a thickness between opposite broad surfaces thereof and comprising a first yarn system arranged into a plurality of layers of yarn between the opposite broad surfaces of the fabric and a second yarn system comprised of a first group of yarns, each of which is confined to one of the plurality of layers of yarn of the first yarn system and is interwoven with the yarn in said one of the plurality of layers, and a second group of yarns, each of which is interwoven with and extends between two and no more than two different adjacent ones of the plurality of layers of yarn of the first yarn system, at least one of the first and second yarn systems being comprised of at least two different groups of yarns of different material composition and extending through different portions of the thickness of the fabric.

10. The invention set forth in claim 9, wherein the first yarn system consists of warp yarns and the second yarn system consists of fill yarns.

11. The invention set forth in claim 9, wherein at least one layer of the plurality of layers of the first yarn system is of different material composition from other ones of the plurality of layers.

* * * * *